United States Patent [19]

Adkins et al.

[11] 4,062,411

[45] Dec. 13, 1977

[54] HYDRAULIC PERCUSSION TOOL WITH IMPACT BLOW AND FREQUENCY CONTROL

[75] Inventors: Richard Wayne Adkins; James R. Mayer, both of Denver, Colo.

[73] Assignee: Gardner-Denver Company, Dallas, Tex.

[21] Appl. No.: 638,205

[22] Filed: Dec. 5, 1975

[51] Int. Cl.[2] ..... E21C 3/20; B25D 9/04; B25D 9/20

[52] U.S. Cl. ..... 173/115; 91/277; 91/284; 91/321; 173/134; 173/DIG. 4

[58] Field of Search ..... 91/277, 284, 289, 303, 91/321, 278; 173/115, 134

[56] References Cited

U.S. PATENT DOCUMENTS

| | | | |
|---|---|---|---|
| 3,552,269 | 1/1971 | Arndt | 91/277 X |
| 3,687,008 | 8/1972 | Densmore | 91/25 |
| 3,741,072 | 6/1973 | Romell et al. | 91/277 X |
| 3,766,830 | 10/1973 | Montabert | 91/321 X |
| 3,774,502 | 11/1973 | Arndt | 91/321 X |
| 3,827,507 | 8/1974 | Lance | 173/15 |
| 3,903,972 | 9/1975 | Bouyoucos | 173/134 |
| 3,908,767 | 9/1975 | Klemm | 91/321 X |
| 3,925,985 | 12/1975 | Peterson | 91/321 X |

*Primary Examiner*—Ernest R. Purser
*Assistant Examiner*—William F. Pate, III
*Attorney, Agent, or Firm*—Michael E. Martin

[57] ABSTRACT

A hydraulic percussion tool for developing repeated impact blows for rock drilling and other high force applications is characterized by a piston hammer reciprocably disposed in a cylinder bore and a tubular valve member coaxial with and actuated by the hammer for controlling the flow of pressurized hydraulic fluid to and from portions of the cylinder bore. The valve member is actuated by the hammer on the return stroke thereof through a column of fluid trapped in an annular chamber formed between a transverse surface on the hammer and an end face of the valve member. Valving mechanism is operable to effect controlled venting of the trapped fluid from the annular chamber to change the position of the valve member with respect to the hammer and thereby control the hammer stroke length, impact blow, and blow frequency.

14 Claims, 8 Drawing Figures

HYDRAULIC PERCUSSION TOOL WITH IMPACT BLOW AND FREQUENCY CONTROL

BACKGROUND OF THE INVENTION

In the art of pressure fluid operated percussion tools it is desirable to control the impact blow energy as well as the blow frequency which is generated for transmission to the tool workings. In particular in the art of rock drilling with percussion drills it has been determined that a rock formation having a particular hardness or compressive strength can be penetrated in the most efficient manner at a particular impact blow energy value taking into consideration the configuration and size (diameter) of the percussion bit. U.S. patent application Ser. No. 621,935, filed Oct. 14, 1975, in the name of James R. Mayer and Dieter K. Palauro, and having the same assignee as this application, provides a more detailed discussion of this desideratum in the art of percussion drilling.

This invention pertains to improvements in a type of hydraulic oscillator adapted for percussion drilling whereby variable impact blow energy and blow frequency may be obtained and easily and conveniently controlled to select the desired hole formation (penetration) rate for a particular type of workings. The general type of hydraulic percussion tool mechanism which may be improved by the subject invention includes the type of apparatus disclosed in U.S. Pat. Nos. 3,896,889; 3,903,972; and 3,911,789.

SUMMARY OF THE INVENTION

The present invention provides for improvements in a pressure fluid actuated percussion tool having a reciprocable piston hammer for delivering repeated impact blows to an anvil or other blow transmission member wherein the impact blow energy and blow frequency may be selectively varied.

The present invention further provides for improvements in a pressure fluid actuated percussion tool having a reciprocable piston hammer and a valve member coaxial with and actuated by the piston hammer wherein the positional relationship of the valve member with respect to the piston hammer can be controlled to effect changes in the hammer stroke length, impact blow energy, and blow frequency.

In accordance with the present invention there is also provided an improved hydraulic pressure fluid operated percussion rock drill which includes means for changing the hammer impact blow energy to substantially any selected value within the drill operating limits, which means may be operated at a remote location with respect to the drill proper and while the drill is in operation.

DESCRIPTION OF THE PREFERRED EMBODIMENTS

Figure 1:
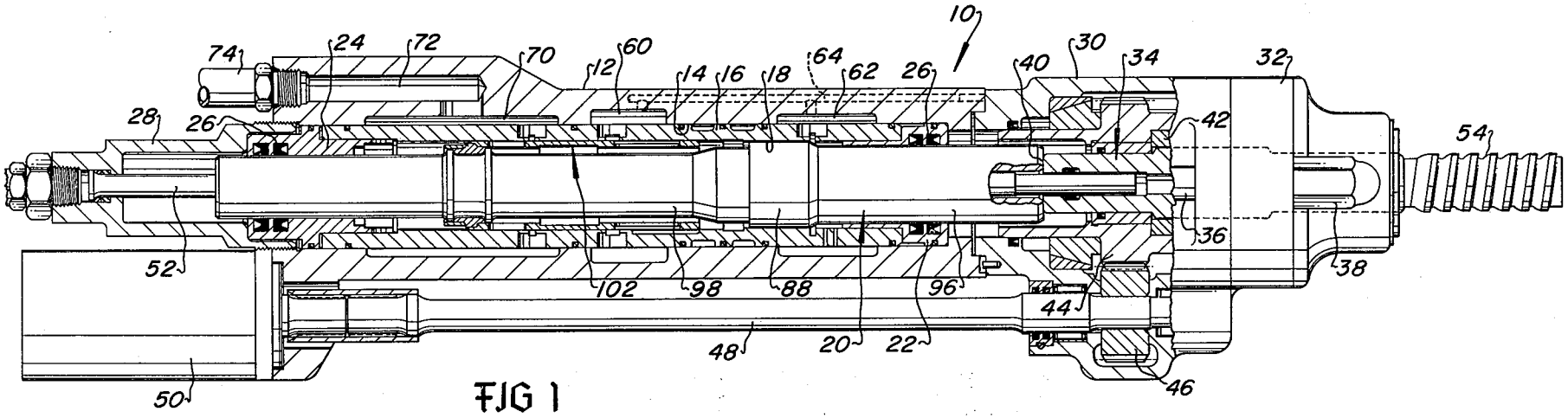
FIG. 1 is a longitudinal section view of a hydraulic percussion tool in accordance with the present invention and is taken substantially along the line 1—1 of FIG. 3.
Figure 3:
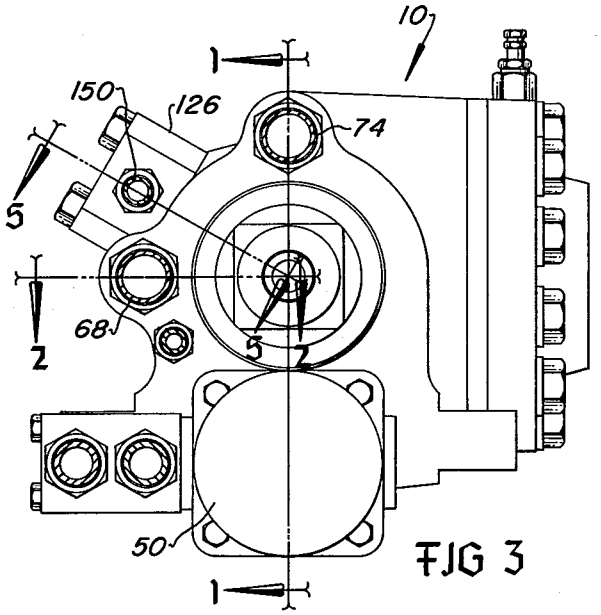
FIG. 3 is a transverse end view of the tool shown in FIG. 1.

Referring to FIGS. 1 through 4 of the drawings the present invention is embodied in a hydraulic percussion tool generally designated by the numeral 10. The tool 10 is adapted for use as a percussion rock drill although the basic hydraulic oscillator mechanism and the improvement thereon disclosed herein may be adapted for other uses.

The tool 10 includes a main casing 12 having a longitudinal bore 14 in which is disposed a cylindrical sleeve or liner 16. The sleeve 16 has a cylindrical bore 18 formed therein and in which bore is disposed an elongated piston hammer 20. The opposite ends of the hammer 20 are slidably disposed in bearing members 22 and 24 which are located in respective opposite ends of the cylinder bore 18. Suitable seals 26 are disposed in the bearing members 22 and 24, respectively, to prevent leakage of hydraulic fluid from cavities which are formed within the bore 18 and which will be described in further detail herein. An end cap 28 is threadedly engaged with the casing 12 and retains the member 24 and the sleeve 16 within the casing as shown.

Figure 8:
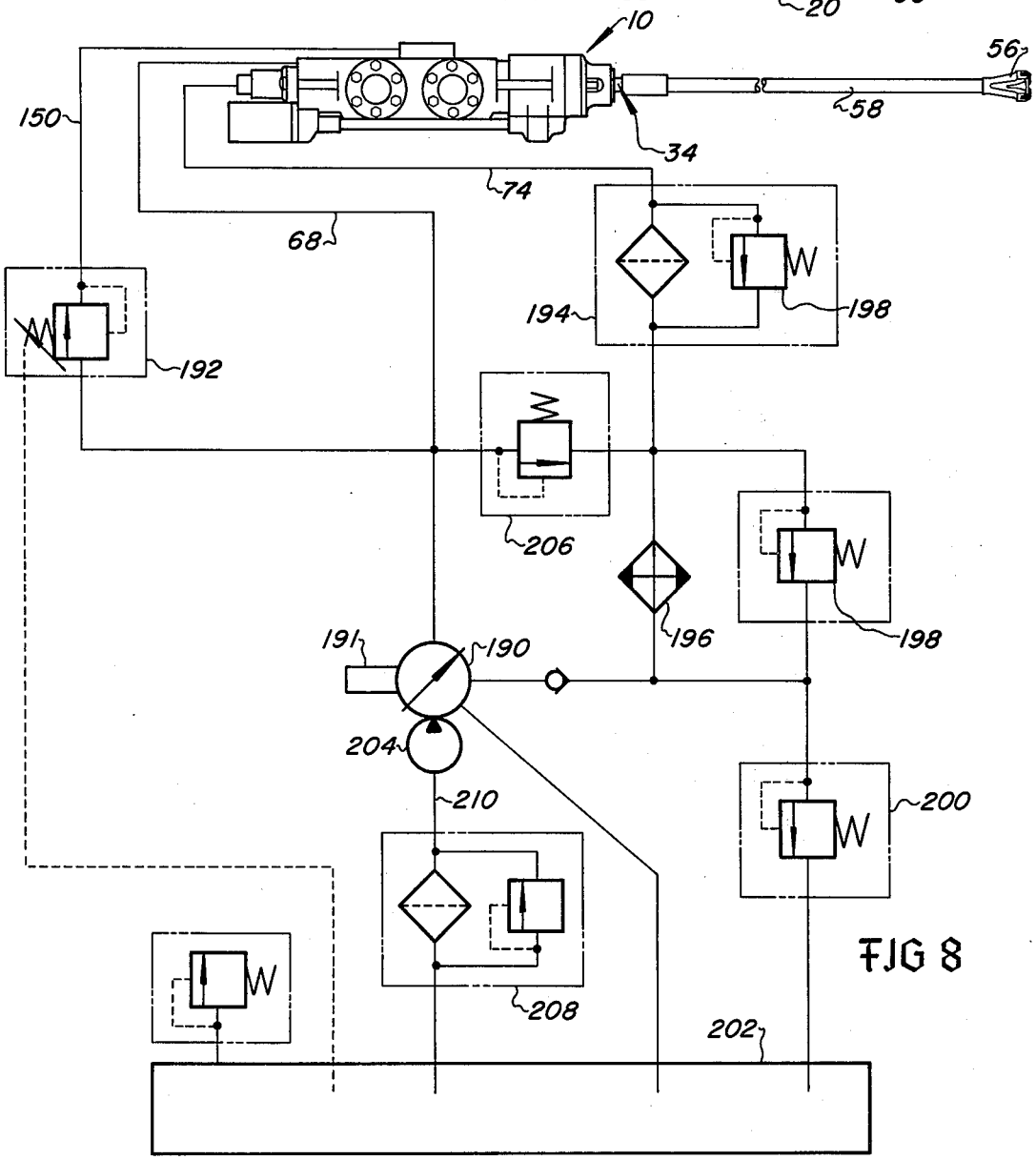

The tool 10 also includes a casing part 30 and an end cap 32 which form a housing for supporting and retaining an impact receiving member or shank 34. The cap 32 and casing part 30 are retained in assembly with the casing part 12 by suitable means such as conventional side rods 36 and cap nuts 38, one of each shown in FIG. 1. The shank 34 includes an impact receiving surface 40 for receiving impact blows from the hammer 20. The shank 34 may also be of the configuration disclosed in U.S. Pat. No. 3,640,351. The shank 34 is disposed in a chuck 42 which is rotatably driven by transmission means comprising gears 44 and 46, and an elongated drive shaft 48. The drive shaft 48 is suitably connected to a rotary fluid motor 50 mounted on the casing 12. A drill hole cleansing fluid tube 52 is disposed to extend through a central axial bore in the hammer 20 and into an axial bore in the shank 34 in a conventional manner as shown in FIG. 1. The shank 34 has a threaded end portion 54 which is adapted for connection to conventional drill stem components including a bit member 56 and an elongated drill rod 58 as shown in FIG. 8.

Figure 2:
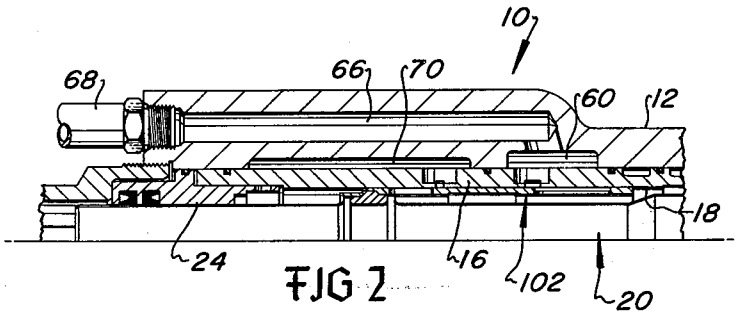
FIG. 2 is a fragmentary longitudinal section view taken along the line 2—2 of FIG. 3.
Figure 4:
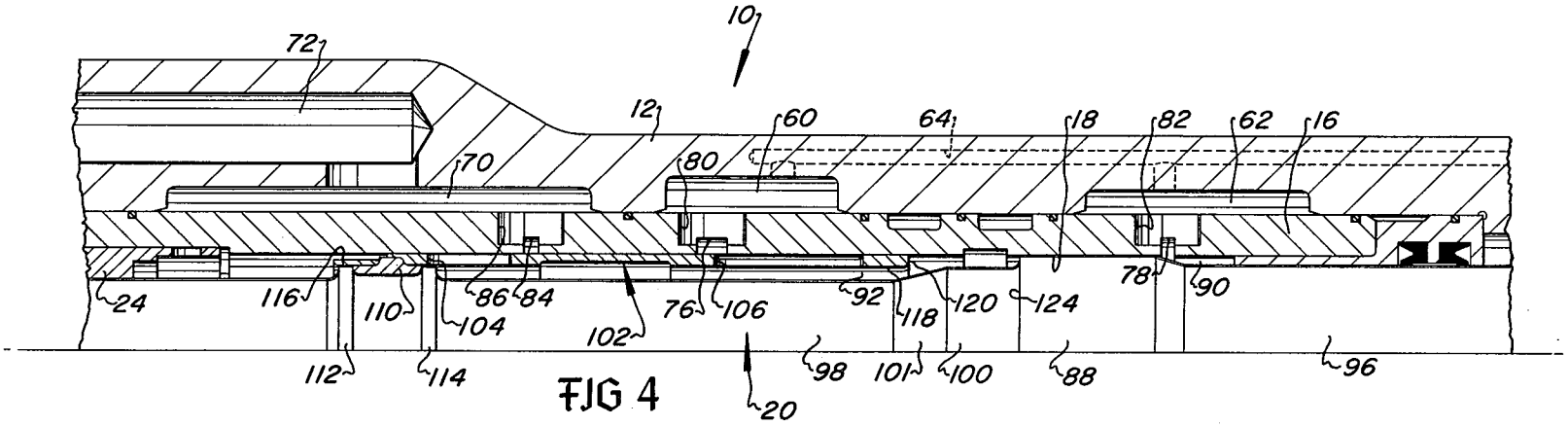
FIG. 4 is a fragmentary section view taken along line 1—1 of FIG. 3, and is on a larger scale than FIG. 1.

Referring to FIGS. 1, 2, and 4 the tool 10 is further characterized by means for conducting hydraulic pressure fluid to the bore 18 which means include annular recesses 60 and 62 which are formed in the casing part 12 and are in communication with each other by way of suitable passages means designated by the numeral 64. As shown in FIG. 2 an inlet passage 66 is formed in the casing part 12 and is in communication with the recess 60. The passage 66 receives fluid at high pressure from a conduit 68 connected to the casing part 12. As shown in FIGS. 1 and 4 a recess 70 is formed in casing part 12 and is in communication with a fluid return passage 72 and a conduit 74 which conducts low pressure fluid from the tool 10.

Referring particularly to FIG. 4 the sleeve 16 includes fluid supply ports 76 and 78 which are formed as peripheral grooves opening into the bore 18. Lateral passages 80 and 82 connect the ports 76 and 78 respectively with the respective recesses 60 and 62. A fluid return port 84, also formed as a peripheral groove, opens from the bore 18 into lateral passages 86 which communicate with the recess 70. The recess 70 may be connected to a hydraulic accumulator, not shown, as may the recesses 60 and 62 be connected to another accumulator, also not shown. U.S. Pat. No. 3,903,972 discloses a similar tool arrangement showing suitable accumulators in circuit generally as described above.

As shown in FIGS. 1 and 4 the hammer 20 is characterized by a portion 88 having a diameter which is only slightly less than the diameter of the bore 18 and which divides the bore into separate fluid cavities 90 and 92. A portion 96 of the hammer 20 is of greater diameter than a portion 98. The portion 98 includes the portion which extends through the bore of the bearing member 24. Accordingly, a transverse pressure surface is formed between the diameters of the portions 88 and 98 and facing the cavity 92 which has a greater axially projected surface area than a transverse pressure surface formed between the portions 88 and 96 and facing the cavity 90. The hammer 20 is further characterized by an intermediate stepped portion 100 between the portions 88 and 98.

Figure 6:
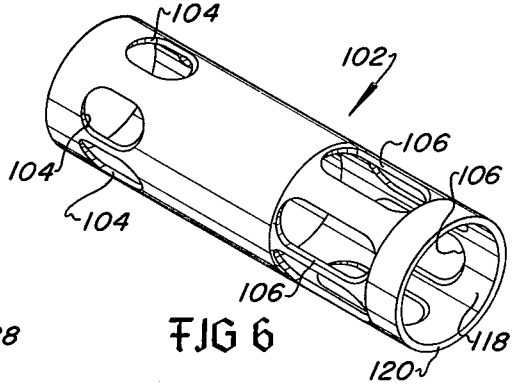
FIG. 6 is a perspective view of the tubular valve member.

The percussion tool 10 includes a tubular valve member generally designated by the numeral 102. The valve member 102 is slidably disposed in close fitting relationship with the wall of the bore 18 and within the cavity 92. The valve member 102 is coaxial with the hammer 20 and is adapted to be engaged by the hammer for reciprocating movement to open and close the respective ports 76 and 84. As shown in FIG. 6 the valve member 102 includes a plurality of ports comprising lateral openings 104 which are spaced apart from a second set of lateral openings 106. The openings 104 are positioned on the valve member 102 so as to uncover the port 84 for communication with the cavity 92 depending on the position of the valve member itself. Similarly, the openings 106 are operable to uncover the port 76 for communication with the cavity 92 when the port 84 is blocked or closed by the valve member 102 as shown, for example, by the position of the valve member in FIG. 4.

Figure 5:
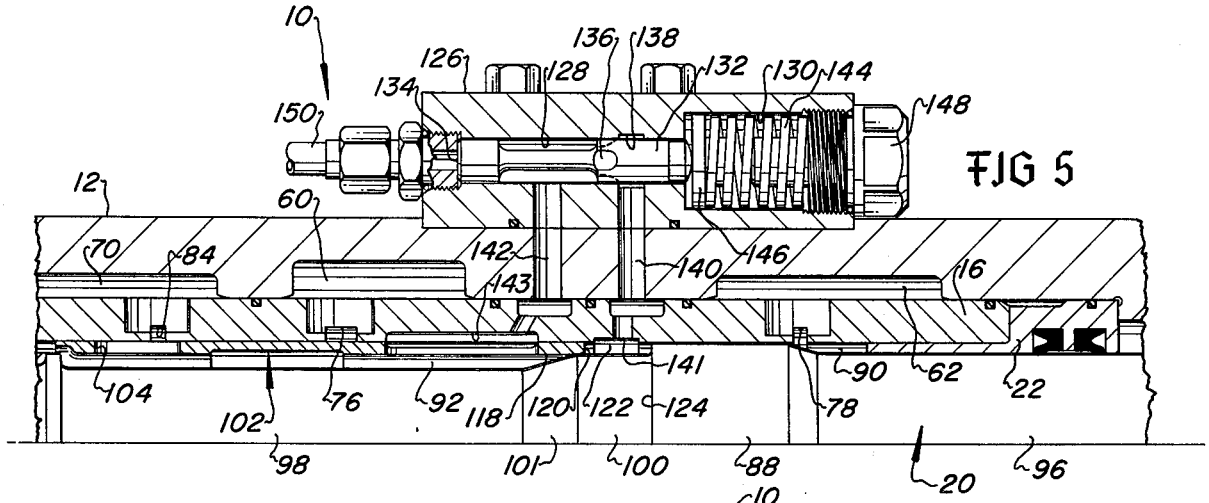
FIG. 5 is a fragmentary section view taken along line 5—5 of FIG. 3.

The hammer 20 is adapted to engage the valve member by a split ring 110 disposed on the hammer between integral collar portions 112 and 114. The ring 110 is held in assembly on the hammer 20 by a sleeve 116. The inside wall surface 118 of the valve member 102 is proportioned to provide for a close fitting relationship with the cylindrical surface of the hammer portion 100. Accordingly, as shown in FIG. 5 when the valve member 102 has moved relative to the hammer so that the end face 120 is adjacent the portion 100 on the hammer an annular movable chamber 122 is formed between the face 120 and a transverse surface 124 on the portion 88 of the hammer. Fluid trapped in chamber 122 will prevent the valve member 102 from moving further toward the surface 124 and, accordingly, if the hammer 20 is moving to the left, viewing FIGS. 1, 4, or 5 the valve member 102 will be moved with the hammer by the trapped column of fluid in the chamber 122. If fluid is allowed to escape from the movable chamber 122, the position of the valve member 102 with respect to the surface 124 on the hammer may be varied.

Referring to FIG. 5 the tool 10 includes means providing for controlled venting of fluid from the chamber 122 wherein the position of the valve member 102 with respect to the hammer 20 may be varied on the return stroke of the hammer. The tool 10 includes a housing 126 disposed on the casing part 12 and including longitudinal contiguous bores 128 and 130. A valve element comprising a spool 132 is disposed in the bore 128 and includes a piston face 134, and a plurality of longitudinal grooves 136 which may be in communication with a recess 138 in the bore 128. Passage means 140 formed in the housing 126, casing part 12 and sleeve 16 connect the chamber 122 with the recess 138 in the bore 128. The passage means 140 includes a circumferential recess 141 in the bore 18 which extends the effective axial length of the passage means 140 with respect to the bore 18. Similar passage means 142 connect the bore 128 with the cavity 92 when the port 84 is in communication with the cavity 92.

The spool 132 is biased to close over the block the passage means 140 by a coil spring 144 disposed in the bore 130 and acting on the spool through a plunger 146. A threaded plug 148 retains the spring 144 in the bore 130. The spool 132 may be moved against the bias of the spring 144 to vent fluid from chamber 122 to cavity 92 by way of passage means 140 and 142 by the introduction of pressure fluid through a conduit 150 to act on the piston face 134. Accordingly, the spool 132 may be positioned by a pressure fluid signal to effect controlled venting of fluid trapped in the chamber 122 which will provide substantially stepless control of the position of the valve member 102 with respect to the hammer 20 when the hammer is moving to the left, viewing FIGS. 1, 4, and 5. The valve member which is characterized by the spool 132 may, of course, take different forms such as, for example, a manually or electromechanically movable closure member which will serve to throttle the flow of fluid out of the chamber 122.

The operation of the tool 10 to effect oscillation of the hammer 20 basically comprises providing a substantially continuous supply of fluid at high pressure to the cavity 90 to urge the hammer away from the shank 34, and alternately supplying pressure fluid to and venting fluid from the cavity 92. With fluid at high pressure supplied to the recesses 60 and 62 and to the cavities 90 and 92 a resultant force will drive the hammer at high velocity toward the shank 34 due to the transverse or axially projected pressure surface formed between the hammer portions 88 and 98 being greater than the transverse pressure surface formed between the portions 88 and 96.

The position of the hammer 20 and the valve 102 shown in FIGS. 1, 2, and 4 is at the instant of impact of the shank 34. In the position of the hammer 20 shown in FIGS. 1, 2, and 4 the valve member 102 is in engagement with the ring 110 having been carried along with the hammer during the impact stroke thereof. During the forward or impact stroke of the hammer 20 the port 84 is blocked by the valve member 102 and the port 76 is in communication with the cavity 92 through the openings 106 in the valve member. When the hammer 20 impacts the shank 34 the momentum of the valve member 102 causes it to disengage from the ring 110 and move forward or toward the hammer portion 88, which movement will result in the port 84 being placed in communication with the cavity 92 through the openings 104 and the closing off or blocking of the port 76. Accordingly, the cavity 92 will be switched from being pressurized by fluid from recess 60 to a vented condition by being placed in communication with the recess 70 and the low pressure return conduit 74. When the fluid pressure in the cavity 92 is reduced a net force due to substantially continuous high pressure in cavity 90 urges the hammer to move to the left, viewing FIGS. 1, 2, 4, and 5.

Referring to FIG. 5, before the hammer 20 has undergone any substantial movement on the return stroke the valve member 102 will move to the right or toward the transverse surface 124 until the face 120 is in the position shown in FIG. 5. When the valve member 102 has moved to the position shown in FIG. 5 fluid will be trapped in the chamber 122 between the face 120 and the surface 124 and further movement of the valve toward the surface 124 will be prevented if the passage means 140 and the recess 138 are blocked by the spool 132. The sloping surface 101 on the hammer 20 cooperates with the valve member 102 to provide some dash pot effect to decelerate the valve member as it approaches the hammer portion 100. If the positional relationship between the hammer 20 and the valve member 102 shown in FIG. 5 is retained during the return stroke of the hammer, the port 84 will be blocked and the port 76 will be opened before the hammer has traveled very far in the bore 18. When the port 76 has been placed in communication with the cavity 92 the hammer 20 will be decelerated and its direction of movement reversed to again be driven toward the shank 34 on the impact stroke.

If, during the movement of the valve member 102 toward the surface 124, the spool 132 is positioned to allow at least some fluid to be vented through the passages 140 and 142 and into the cavity 92 the valve member will move farther into the chamber 122 toward the surface 124. In the limiting condition the face 120 may engage the surface 124 and the valve member 102 will then be moved with the hammer 20 on its return stroke over a greater distance before the ports 84 and 76 are respectively closed and opened to again pressurize the cavity 92. Severe impacting of the surface 124 by the end face 120 of the valve member may be controlled by limiting the full open position of the spool 132 or by a controlling orifice in the passage means 140 or 142. The closer the face 120 is to the surface 124 the longer will be the return stroke of the hammer 20 before the cavity 92 is pressurized to arrest the return stroke and accelerate the hammer on the impact stroke. As shown in FIG. 5 an elongated channel 143 opens into the bore 18. The channel 143 is operable to be in fluid flow communcation with the chamber 122 as the valve 102 and hammer 20 move rearwardly on the return stroke out of communication with the passage means 140 whereby the chamber 143 is required to prevent cavitation in chamber 122 and to facilitate relative movement of the valve 102 with respect to the hammer 20 as the impact stroke begins.

As discussed in the aforementioned U.S. patent application Ser. No. 621,935, the relatively long impact strokes of a fluid actuated percussion tool of the type disclosed in said application and of the type disclosed herein will deliver greater impact blow energy to the shank and the remainder of the blow transmission means such as the drill stem and bit. The short hammer strokes will deliver less impact blow energy and the hammer oscillation cycle will be greater, hence greater impact blow frequency will be obtained. Accordingly, by applying pressure fluid at a controlled pressure to act on the face 134 of spool 132 the spool may be positioned to provide a progressively larger opening between the passage means 140 and 142 to allow fluid to be displaced from the chamber 122. The position of the valve member 102 with respect to the hammer 20, on the hammer return stroke, may thereby be controlled to provide substantially stepless control of the hammer stroke length, impact blow energy and blow frequency.

Figure 7:
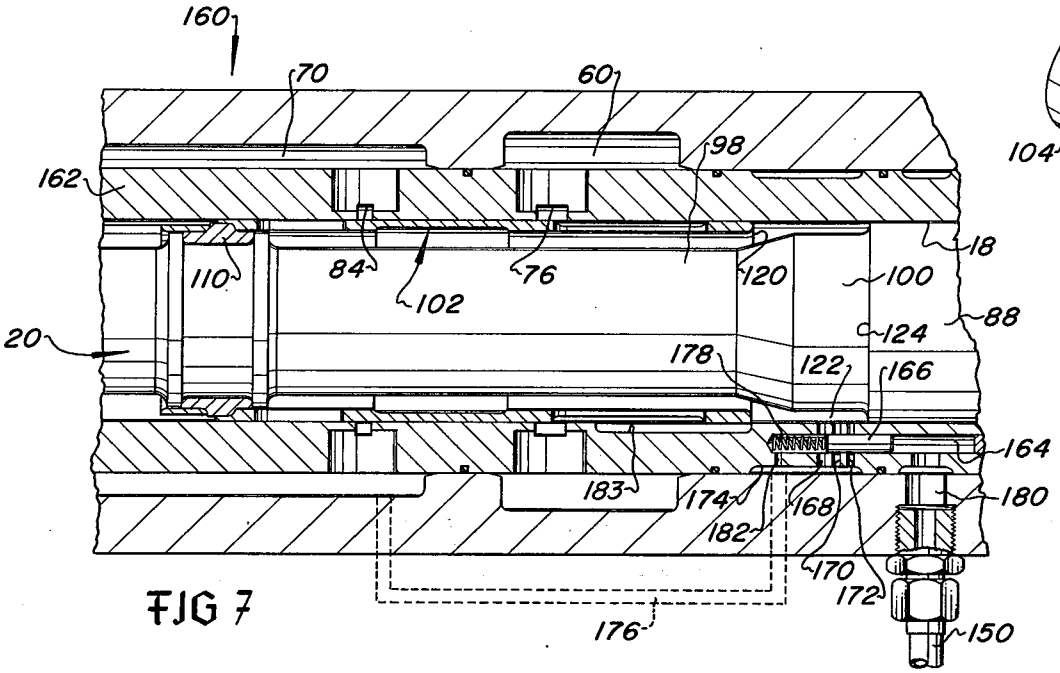
FIG. 7 is a longitudinal section view of a hydraulic percussion tool as shown in FIGS. 1 through 4 but including an alternate embodiment of a mechanism for controlling the impact blow and blow frequency; and, FIG. 8 is a schematic of a hydraulic pressure fluid circuit for use with the hydraulic percussion tool of the present invention.

An alternate embodiment of the valving mechanism for controlling the position of the valve member 102 with respect to the hammer 20 is shown in FIG. 7. The general arrangement of a hydraulic percussion tool in accordance with the present invention is shown in FIG. 7 and generally designated by the numeral 160. The tool 160 is similar to the tool 10 except as herein noted. In the tool 160 a cylinder sleeve 162 is characterized by a longitudinal bore 164 in which is disposed a piston 166. Lateral passages 168, 170, and 172 intersect the bore 164 and open into the chamber 122 formed in part by the hammer 20. Channel means 183 are formed in the bore 164 for operation in the same manner as the channel means 143 of the embodiment of FIGS. 1 through 5. In the view of FIG. 7 the hammer 20 is assumed to be in the impact position shown in FIG. 1. The passages 168, 170, and 172 also open into an annular recess 174 formed in the outer wall of the sleeve 162. Suitable passage means 176, shown schematically in FIG. 7, interconnects the low pressure recess 70 with the recess 174.

The piston 166 is biased to uncover the passages 168, 170, and 172 by a coil spring 178 and the piston is biased to close over one or more of the aforementioned passages by pressure fluid supplied by conduit 150 to the bore 164 through suitable passage means 180. A small relief passage 182 is provided to vent the bore 164 in the portion thereof where the coil spring 178 is disposed. As in the embodiment of FIGS. 1 through 5 controlled application of pressure fluid to act on the piston 166 will provide for venting the chamber 122 to change the position of the valve member 102 with respect to the hammer 20 during the return stroke portion of the hammer oscillation cycle. In the embodiment of FIG. 7 a somewhat stepped control of hammer impact blow energy and blow frequency will be obtained; however, the piston 166 and the passages 168, 170, and 172 might be modified to provide substantially stepless control of venting of pressure fluid from the chamber 122.

FIG. 8 illustrates a schematic of a preferred hydraulic fluid system for operating the improved percussion tool of the present invention. Referring to FIG. 8 hydraulic pressure fluid is supplied to operate the tool 10 by a hydraulic pump 190 of the constant hydraulic power type, that is, a pump which includes control means 191 for controlling the pump to supply hydraulic fluid to the tool 10 at variable pressure and flow rate to provide a substantially constant power value. The pump 190 supplies the conduit 68 with high pressure fluid and also supplies fluid through conduit 150 for operation of the valving mechanism for effecting variable impact blow and blow frequency. An adjustable pressure regulator 192 is interposed in conduit 150 for controlling the fluid pressure acting on the spool 132 or piston 166.

The pump 190 normally receives inlet pressure fluid from the conduit 74 by way of a suitable filter 194 and hydraulic fluid cooler 196. Both the filter 194 and the cooler 196 include suitable pressure relief valves 198 in circuit, as shown in FIG. 8. A pressure relief valve 200 is also connected to the fluid return portion of the hydraulic flow circuit and is in communication with a reservoir 202. The closed circuit fluid system illustrated may be replenished by a charging pump 204 for supplying fluid to the main pump 190, as needed. A pressure relief valve 206 for limiting the maximum pump supply pressure is interposed in the circuit as shown and a suitable filter and pressure bypass valve 208 are disposed in the replenishment inlet conduit 210 leading to the charging pump 204.

The hydraulic fluid circuit shown in FIG. 8 is deemed desirable for use with the percussion tool embodiments disclosed herein and particularly when such tools are adapted in accordance with the present invention to provide variable impact blow energy and blow frequency. By providing a substantially constant hydraulic fluid power input to the tools 10 or 160 the intended improvement in performance of the tool obtainable by changing the impact blow energy and blow frequency is enhanced because the total energy supplied to the tool and the tool workings is not reduced. Moreover, by providing pump means in circuit with the tool which can be automatically controlled to supply substantially constant fluid power it is not necessary for the tool operating personnel to attempt to make adjustments in the hydraulic fluid flow or pressure input to the tool for every change in hammer stroke length.

What is claimed is:

1. A tool for generating percussive forces comprising:

a casing including means defining a bore;

a piston disposed for reciprocating movement in said bore over a forward stroke and a return stroke and including a first portion dividing said bore into first and second cavities;

means for introducing pressure fluid into said first cavity for substantially continuously urging said piston to be displaced in one direction of movement;

inlet and outlet ports in communication with said bore for respectively conducting pressure fluid to and from said second cavity;

a tubular valve member disposed in said second cavity coaxial with said bore and operable to be actuated by said piston to slide along said bore to alternately open and close said inlet and outlet ports for establishing alternating fluid pressures in said cavity to effect reciprocating oscillatory movement of said piston;

surface means on said piston cooperable with said valve member to define a closable chamber for entrapping pressure fluid therein, said piston being operable to actuate said valve member in at least one direction of movement of said valve member through pressure fluid entrapped in said chamber; and, means for controlling the stroke length of said oscillatory movement of said piston by causing said valve member to open and close said inlet and outlet ports in varying relation to the position of said piston in said bore.

2. The invention set forth in claim 1 wherein:

said means for controlling the stroke length of said piston includes means for venting pressure fluid from said chamber to change the position of said valve member with respect to said piston during said one direction of movement of said valve member.

3. The invention set forth in claim 2 wherein:

said chamber is defined in part by said bore, and said means for venting pressure fluid from said chamber includes passage means opening into said bore for conducting pressure fluid from said chamber.

4. The invention set forth in claim 3 wherein:

said means for venting pressure fluid from said chamber includes valving mechanism interposed in said passage means for effecting controlled venting of pressure fluid from said chamber.

5. The invention set forth in claim 4 wherein:

said valving mechanism is pressure fluid actuated to control the venting of pressure fluid from said chamber.

6. The invention set forth in claim 4 wherein:

said passage means include a passage opening into said second cavity for venting pressure fluid from said chamber into said second cavity when said outlet port is in communication with said second cavity.

7. The invention set forth in claim 6 wherein:

said valve member includes ports opening laterally through the tubular wall of said valve member and said passage opens into said second cavity through said ports in said valve members.

8. The invention set forth in claim 1 wherein:

said valve member includes a transverse end face defining.in part, said chamber.

9. The invention set forth in claim 4 wherein:

said passage means comprises a plurality of passages opening into said bore in said casing at longitudinally spaced intervals along said bore and said valving mechanism comprises a closure member for progressively uncovering one or more of said plurality of passages in accordance with the desired stroke length of said piston.

10. The invention set forth in claim 1 wherein:

said tool includes an impact receiving member disposed to receive impact blows from said piston on the forward stroke of said piston and to transmit said impact blows to a rock breaking bit portion or the like, and said piston is operable to actuate said valve member through pressure fluid entrapped in said chamber during the return stroke of said piston.

11. The invention set forth in claim 10 together with:

a hydraulic pressure fluid circuit including a pump for supplying pressure fluid to said tool to effect oscillation of said piston to deliver repeated impact blows to said impact receiving member, said circuit including control means for controlling the supply of pressure fluid to said tool to remain at a substantially constant power value.

12. The invention set forth in claim 4 together with:

channel means formed in said bore for placing said second cavity in fluid flow communication with said chamber in response to said chamber moving into communication with said channel means to thereby provide for movement of said valve member with respect to said piston.

13. The invention set forth in claim 5 together with:

a source of pressure fluid, conduit means connected to said source and said valving mechanism for actuating said valving mechanism, and pressure regulating means interposed in said conduit means for controlling the fluid pressure acting on said valving mechanism to control the venting of pressure fluid from said chamber.

14. The invention set forth in claim 8 wherein:

said chamber comprises an annular space in said second cavity further defined by said surface means on said piston, and the bore wall of said casing, said surface means on said piston comprising a surface on said first portion of said piston and the circumferential surface of a cylindrical portion of said piston adjacent said first portion.

* * * * *